US006418680B1

(12) United States Patent
Calkins

(10) Patent No.: US 6,418,680 B1
(45) Date of Patent: Jul. 16, 2002

(54) LOG PANEL SYSTEM WITH PANELS COMPRISING A PLURALITY OF STACKED LOGS AND AN END BOARD FIXEDLY ATTACHED TO THE ENDS OF EACH PANEL

(76) Inventor: Dennis P. Calkins, 8664 S. Rte. 220 Hwy., Linden, PA (US) 17744

( * ) Notice: Subject to any disclaimer, the term of this patent is extended or adjusted under 35 U.S.C. 154(b) by 0 days.

(21) Appl. No.: 09/550,244

(22) Filed: Apr. 14, 2000

Related U.S. Application Data

(60) Provisional application No. 60/129,566, filed on Apr. 16, 1999.

(51) Int. Cl.[7] ..... E04B 1/10

(52) U.S. Cl. ..... 52/233; 52/747.1; 52/592.6

(58) Field of Search ..... 52/233, 460, 461, 52/730.7, 747.1, 574, 589.1, 592.6

(56) References Cited

U.S. PATENT DOCUMENTS

| | | | | | |
|---|---|---|---|---|---|
| 2,309,426 | A | * | 1/1943 | Williams | 52/233 |
| 2,320,466 | A | * | 6/1943 | Presley | 52/233 |
| 3,979,862 | A | * | 9/1976 | Hamilton et al. | 52/90 |
| 4,154,036 | A | * | 5/1979 | Moss et al. | 52/282 |
| 4,463,532 | A | * | 8/1984 | Faw | 52/233 |
| 4,807,413 | A | * | 2/1989 | Randall | 52/233 |
| 4,909,012 | A | * | 3/1990 | Thompson, Jr. et al. | 52/741 |
| 4,981,003 | A | * | 1/1991 | McCarthy | 52/309.7 |
| 5,010,701 | A | * | 4/1991 | Halsey, Jr. et al. | 52/233 |
| 5,265,390 | A | * | 11/1993 | Tanner | 52/233 |

* cited by examiner

*Primary Examiner*—Carl D. Friedman
*Assistant Examiner*—Naoko Slack
(74) *Attorney, Agent, or Firm*—John J. Elnitski, Jr.

(57) ABSTRACT

The present invention is a log panel system for constructing buildings using prefabricated panels made of full size logs. The log panel system includes log panels and fasteners. The log panels can be pre-built at a factory and assembled into a building at the site where the building is to stand. Each log panel is made from individual logs fastened together. Each log has a two sides, two ends, a top and a bottom. The top and bottom of all of the logs are flat surface, whereby the top includes a tongue extending upward from the log and the bottom includes a groove to receive the tongue of another log. The log panel is formed by placing a first log to receive a second log. The second log is placed on top of the first log such that the groove of the second log fits over the tongue of the first log, in order to provide the beginning of an assembly of logs to form the log panel. Fasteners are then driven from above the second log into the tongue of the second log , through the second log, through the bottom of the second log, into the tongue of the first log and finally into the first log. This assembly process is repeated by adding new logs to the current assembly of logs to build a log panel.

20 Claims, 11 Drawing Sheets

LOG PANEL SYSTEM WITH PANELS COMPRISING A PLURALITY OF STACKED LOGS AND AN END BOARD FIXEDLY ATTACHED TO THE ENDS OF EACH PANEL

This application claims the benefit of U.S. Provisional Application No. 60/129,566 filed Apr. 16, 1999 and hereby incorporates it by reference.

BACKGROUND

There are many prefabricated building panel systems and systems which simulate a log building on the market. Currently, there is no full blown prefabricated panel system which utilizes full size logs in a convenient manner, yet provides the strength and insulative qualities of full size log buildings.

It is an object of the present invention to provide a prefabricated panel system which utilizes full size logs.

SUMMARY OF THE INVENTION

The present invention is a log panel system for constructing buildings using prefabricated panels made of full size logs. The log panel system includes log panels and fasteners. The log panels can be pre-built at a factory and assembled into a building at the site where the building is to stand. Each log panel is made from individual logs fastened together. Each log has a two sides, two ends, a top and a bottom. The top and bottom of all of the logs are flat surface, whereby the top includes a tongue extending upward from the log and the bottom includes a groove to receive the tongue of another log. The log panel is formed by placing a first log to receive a second log. The second log is placed on top of the first log such that the groove of the second log fits over the tongue of the first log, in order to provide the beginning of an assembly of logs to form the log panel. Fasteners are then driven from above the second log into the tongue of the second log , through the second log, through the bottom of the second log, into the tongue of the first log and finally into the first log. This assembly process is repeated by adding new logs to the current assembly of logs to build a log panel.

DETAILED DESCRIPTION OF THE INVENTION

Figure 1:
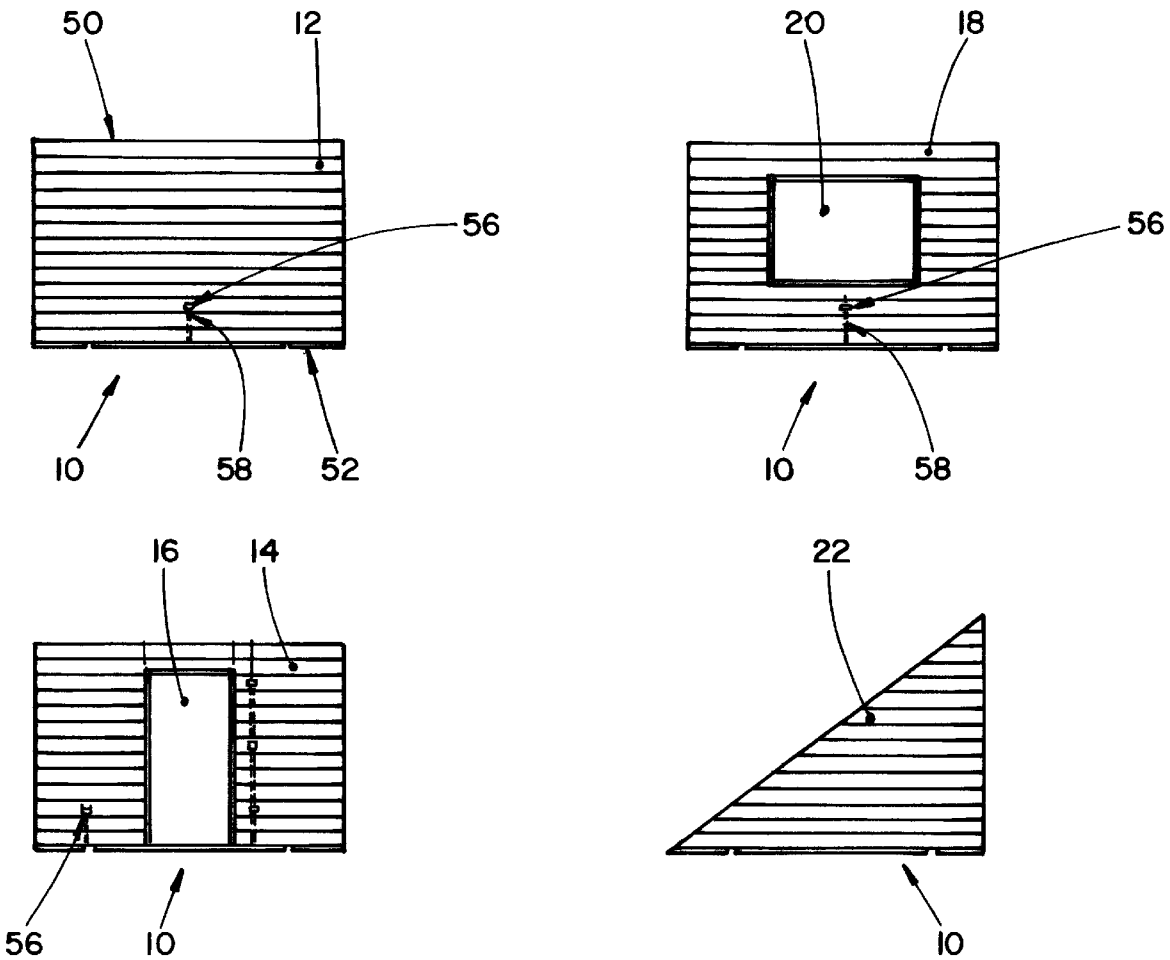
FIG. 1 is a front view of different log panels according to the present invention.
Figure 2:
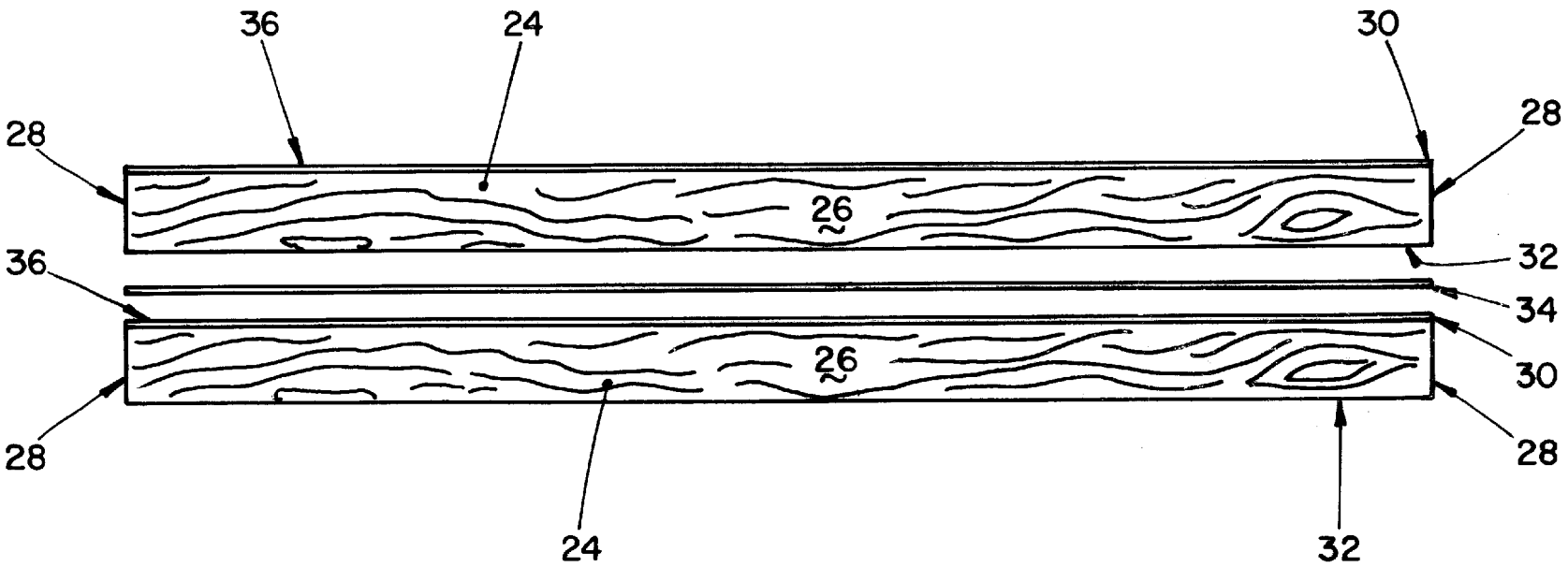
FIG. 2 is a front view of an assembly of two logs according to the present invention.
Figure 3:
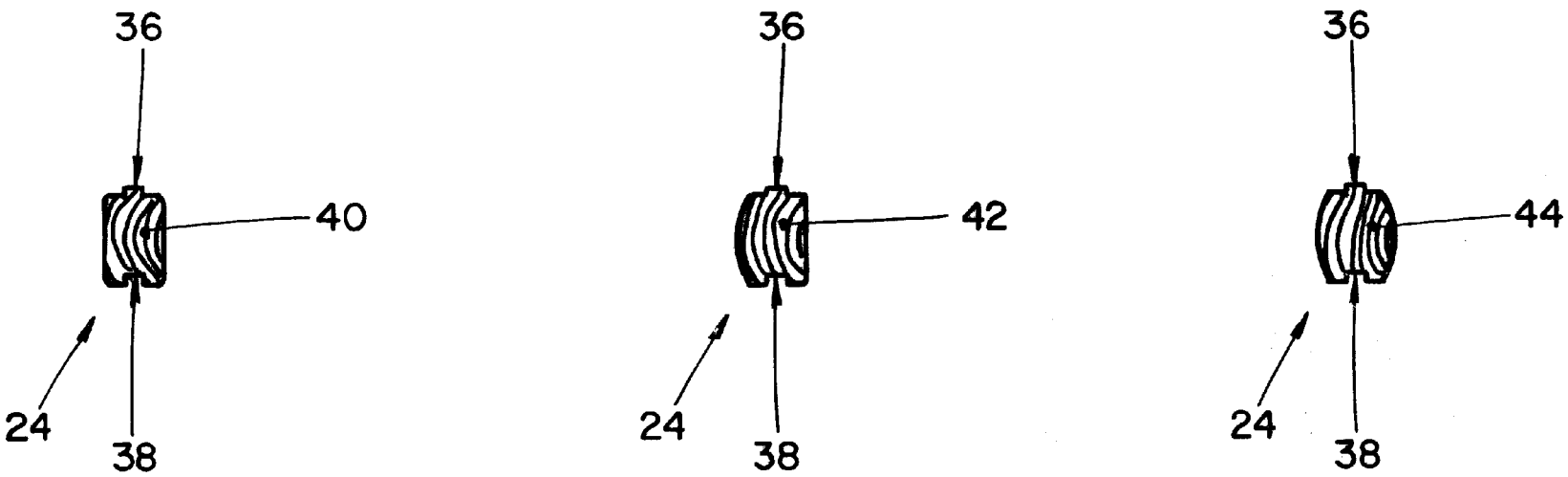
FIG. 3 is an end view of different logs according to the present invention.

The present invention is a log panel system for constructing buildings using prefabricated panels made of full size logs. The log panel system includes log panels 10 and fasteners 11. The log panels 10 can be pre-built at a factory and assembled into a building at the site where the building is to stand. Examples of log panels 10 are shown in FIG. 1. Panel 12 is a solid wall panel. Panel 14 is a panel with a doorway 16. Panel 18 is a panel with a window 20. Panel 22 is a panel to act as gable end and as an end roof truss. Each log panel 10 is made from individual logs 24 fastened together. Each log 24 has a two sides 26, two ends 28, a top 30 and a bottom 32. FIG. 2 shows a side view of two logs 24 and a layer of insulation 34 between the logs 24. FIG. 3 shows an end view of three different styles of logs 24. The top 30 and bottom 32 of all of the logs 24 are flat surface, whereby the top 30 includes a tongue 36 extending upward from the log 24 and the bottom 32 includes a groove 38 to receive the tongue 36 of another log 24. The side 40 profile of log 24 is shown having flat sides. The side profile 42 of log 24 is shown having one round side and one flat side, giving it a "D" shape. The side profile 44 of log 24 is shown having round sides.

Figure 4:
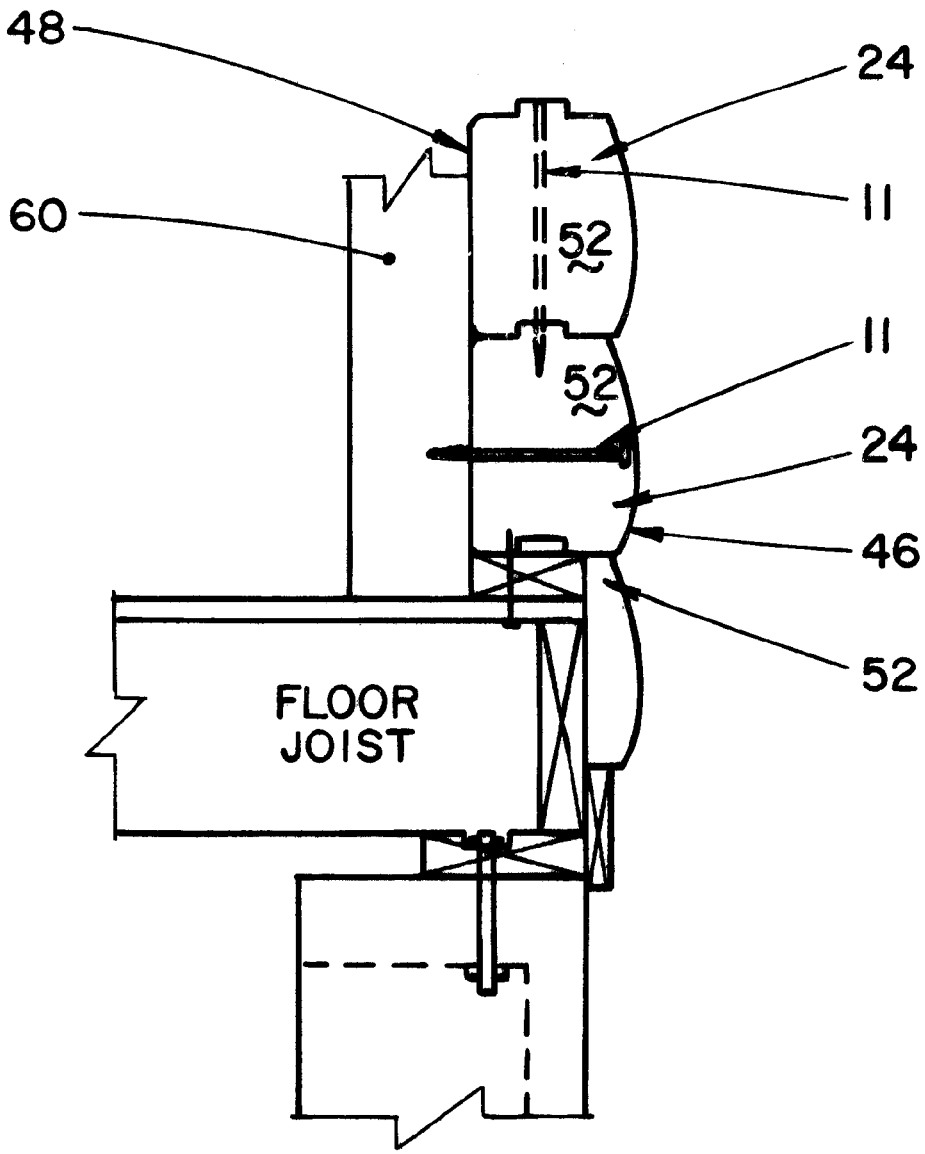
FIG. 4 is an end view of an assembly of two logs according to the present invention.
Figure 5:
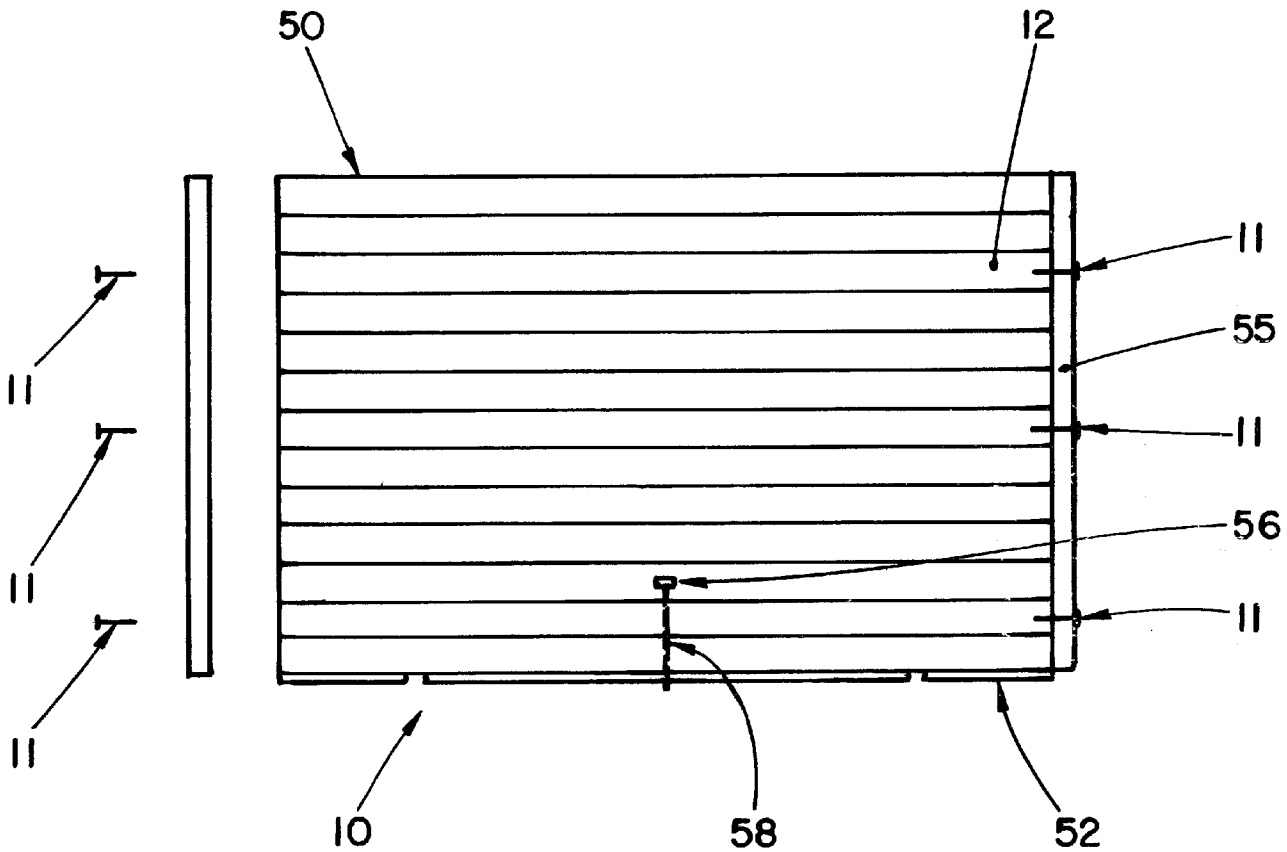
FIG. 5 is a front and exploded view of a log panel according to the present invention.

As shown in FIG. 4, the logs 24 are assembled to form the log panel 10 as follows. A first log 24 is placed to receive the application of insulation and sealant on the top 30 and the tongue 36 of the first log 24. The insulation and sealant are of the typical type used in the construction of buildings. A second log 24 is placed on top of the first log 24 such that the groove 38 of the second log 24 fits over the tongue 36 of the first log 24, in order to provide the beginning of an assembly of logs 24 to form the log panel 10. Fasteners 11 are then driven from above the second log 24 into the tongue 36 of the second log 24, through the second log 24, through the bottom 32 of the second log 24, into the tongue 36 of the first log 24 and finally into the first log 24. This assembly process is repeated by adding new logs 24 to the current assembly of logs 24 to build a log panel 10. The fasteners 11 are typically a long screw and are spaced no more that thirty six inches apart and no more than twelve inches from each end 28 of the logs 24. The log panel 10 produced is a panel having an exterior side 46, an interior side 48, a top, 50 a bottom 52 and two ends 54. As, shown in FIG. 5, an end board 55 can be added to each end 54 of the log panel 10 using fasteners 11. The end board 55 adds strength and stability to the log panel 10. Windows and doors are formed in a log panel 10 by using a series of two logs 24 of shorter length, instead of a full length log 24. FIG. 1 also shows electrical boxes 56 and wire passageways 58. Conduit can be placed in the wire passageways 58. The electrical boxes 56 and wire passageways 58 are installed during assembly of the logs 24, whereby material of the each log 24 is to make the wire passageways 58 and to install the electrical boxes 56.

Figure 6:
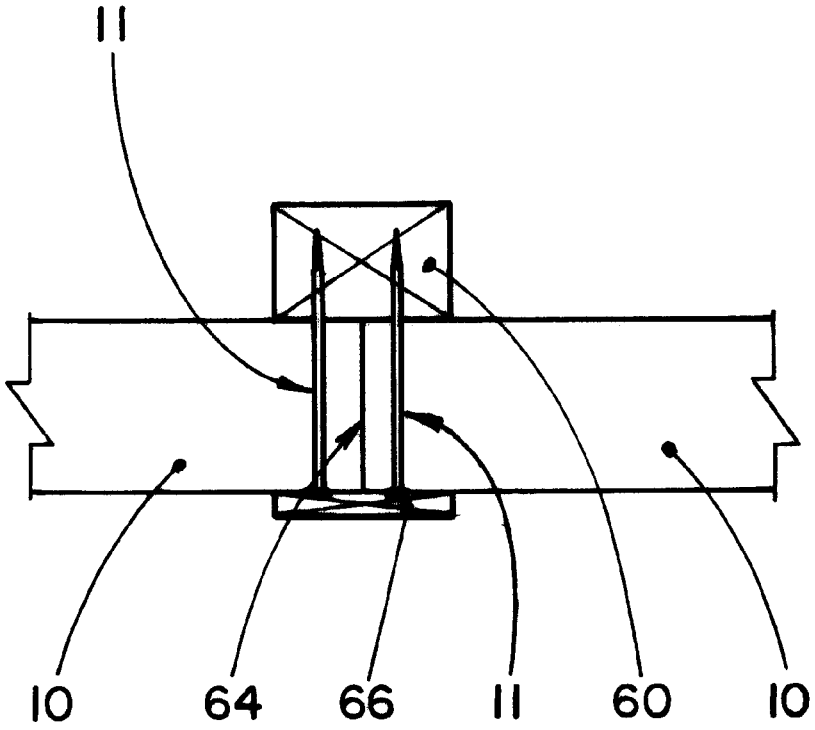
FIG. 6 is a top view of an assembly of two log panels according to the present intention.
Figure 7:
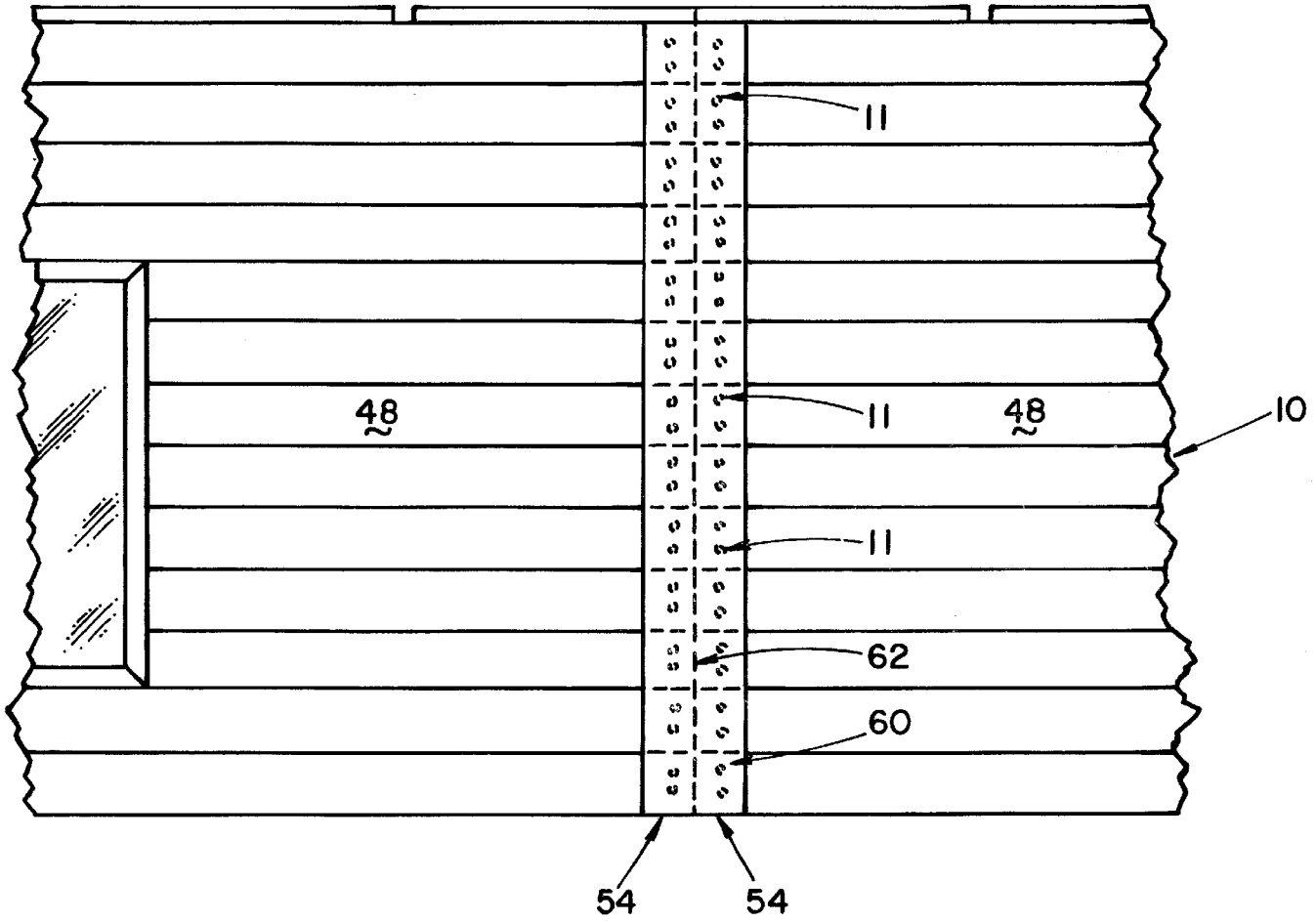
FIG. 7 is a front view of an assembly of two log panels according to the present invention.
Figure 8:
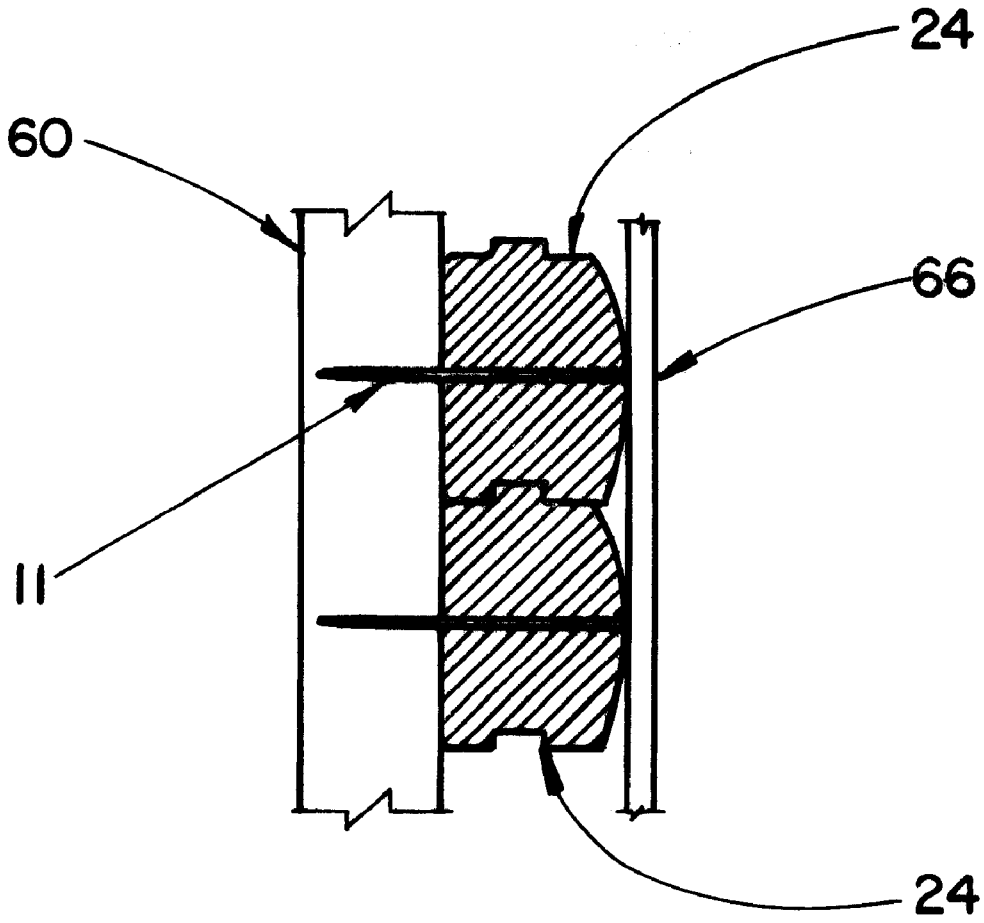
FIG. 8 is an cross-sectional view of an assembly of two log panels according to th present invention.
Figure 9:
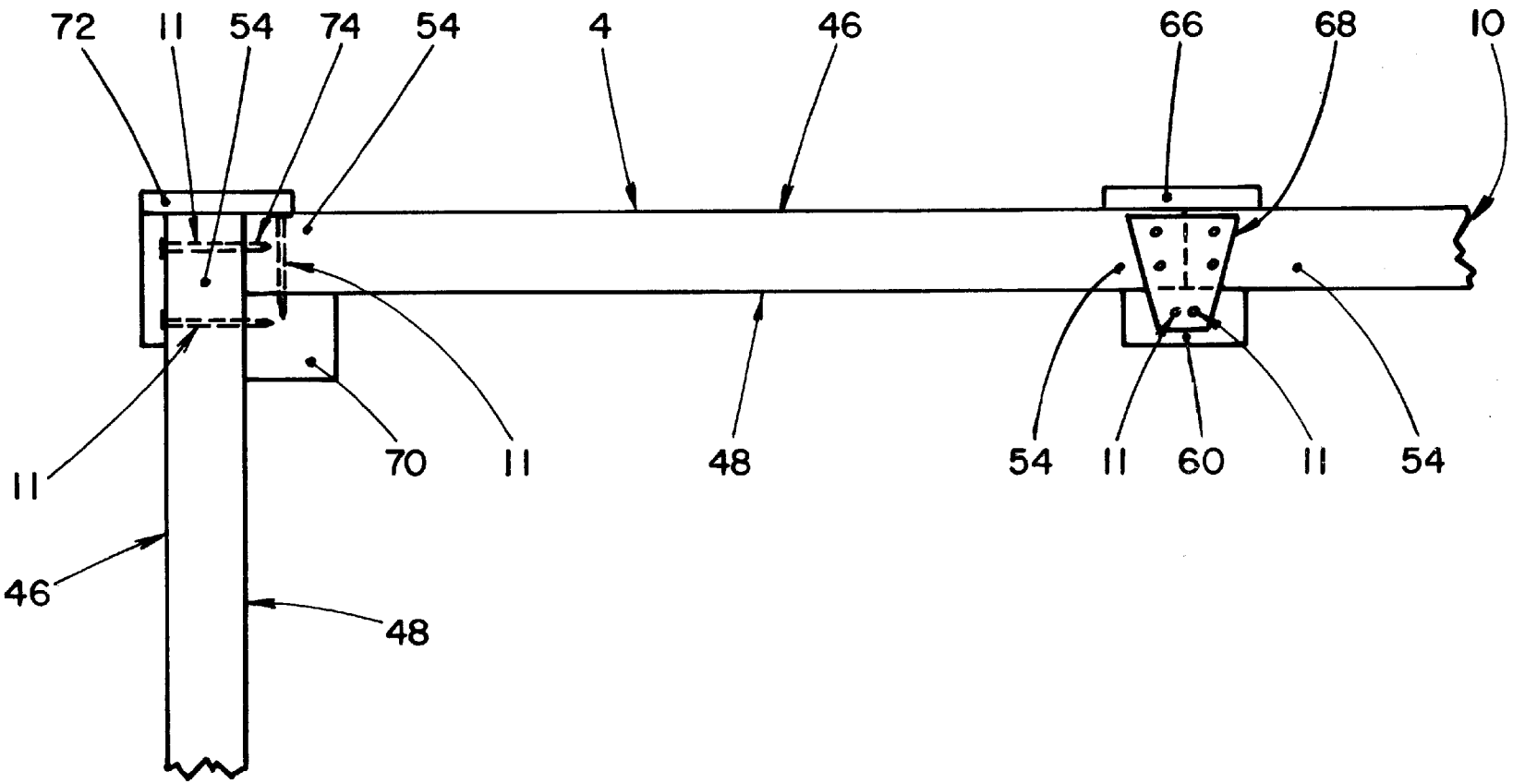
FIG. 9 is a top view of an assembly of two log panels into a corner according to the preset invention.

The log panels 10 are assembled to form an exterior wall as follows. The end 54 of one log panel 10 is butted against the end 54 of another log panel 10, as shown in FIGS. 6–7. The log panels 10 which include the end boards 55 would actually butt the end boards 55 together, instead of the ends 54. A four inch thick by eight inch wide support board 60 having a centerline 62 along the width of the support board 60 is placed on the interior side 48 of the log panels 10, such that centerline 62 of support board 60 is aligned in parallel with a joint 64 formed by the butting of the two log panels 10 together. Fasteners 11 are driven from the exterior side 46 into each of the logs 24 at the ends 54 where the log panels 10 butt. These fasteners 11 are driven through the logs 24 and into the support board 60, as shown in FIGS. 6 and 8. A one inch thick by eight inch wide trim board 66 is used to cover the joint 64 and hide heads of the fasteners 11. Gussets 68 can be added at the top 50 or bottom 52 of the log panels 10, where the log panels 10 butt, as shown in FIG. 9. Fasteners 11 are driven into the gusset 68 and on into the log 24 or support board 60, as shown to provide more strength at the joint 64.

Figure 10:
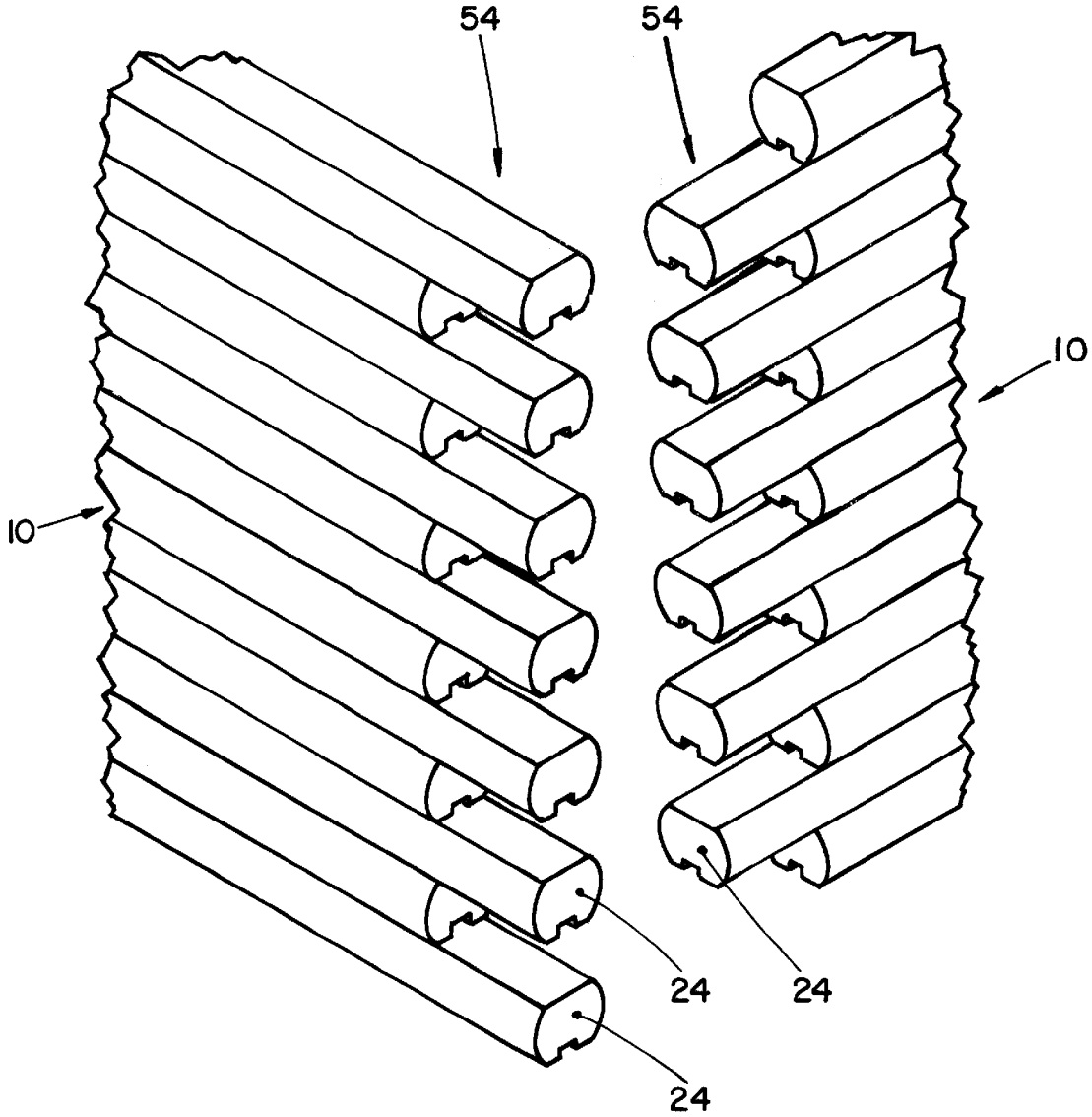
FIG. 10 is an exploded perspective view of an assembly of two log panels into a corner according to the present invention.
Figure 11:
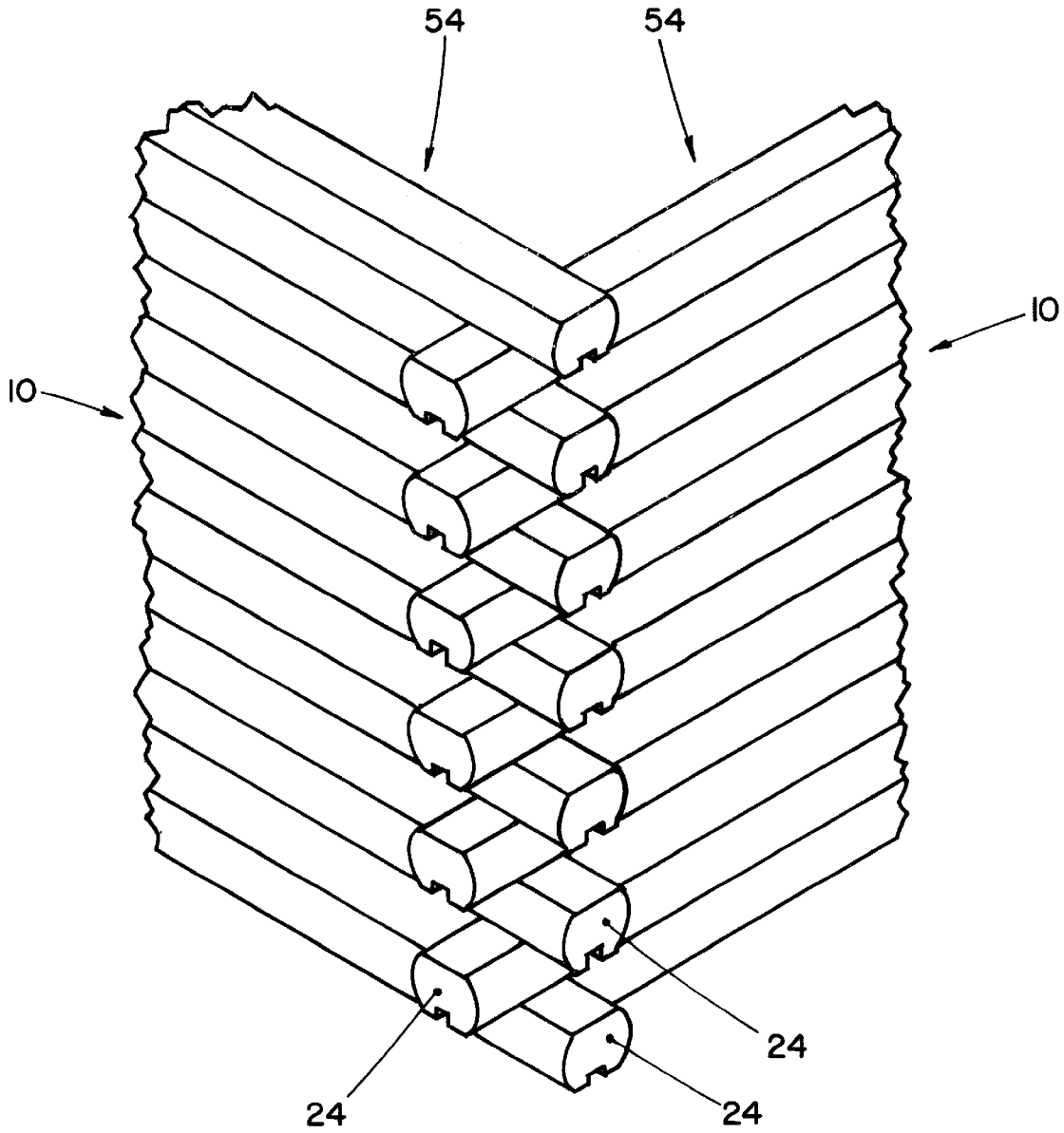
FIG. 11 is an perspective view of an assembly of two log panels into a corner according to the present invention.

Corners of the building are formed by the panels in one of the two following methods, as shown in FIGS. 9–11. The first way is to butt an end 54 of a first log panel 10 into the interior side 48 of one end 54 of a second log panel 10, as shown in FIG. 9. One or both of the first and second log panels 10 can include an end board 55 which would be used to butt, instead of the ends 54. A corner post 70 is positioned such that one side of the corner post 70 is against interior side 48 of the first log panel 10, while another side of the corner post 70 is against the interior side 48 of the second log panel 10. Fasteners 11 are driven into the logs 24 near the ends 54 of the log panels 10 from the exterior side 46 and on into the corner post 70, as shown in FIG. 9. A one inch thick by eight inch wide trim board 72 is used to cover a joint 74 formed by the log panels 10 and to hide heads of the fasteners 11. The second method is shown in FIGS. 10–11. The second method is to shorten every other log 24 on one end 54 of a first and second log panel 10 on the ends 54 that will butt into a corner. Whereby, the shortening of the logs 24 on the first log panel 10 is alternated with the shortening of the logs 24 of the second log panel 10, such that the ends 54 of both log panels 10 will mate together, as shown in FIGS. 10–11. For this type of corner, the tongue 36 of the logs 24 not shorten must be removed to allow the logs 24 of the other log panel 10 to pass. A corner post 70 may also be used for the second method, as described above.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention which is to be given the full breadth of any and all equivalents thereof.

I claim:

1. A log panel system for construction of buildings, comprising at least one log panel having an interior side, exterior side, a top, a bottom and two ends; said log panel including a plurality of stacked logs; each of said stacked logs having two sides, a top, a bottom, a tongue on said top and a groove on said bottom to receive said tongue from another log; and an end board fixedly attached to each end of said log panel.

2. The log panel system of claim 1, further including fasteners which are long enough to be driven into one of said logs from above said tongue, into said one of said logs and on into another of said logs positioned below said one of said logs.

3. The log panel system of claim 2, further including insulation and sealant between said logs.

4. The log panel system of claim 1, further including a support board and fasteners; said support board to be positioned against the interior side of a joint formed by butting one of said ends of one log panel and another of said ends of another log panel; and said fasteners to be driven through said logs of said log panel near said joint and on into said support board.

5. The log panel system of claim 4, further including a trim board to cover said fasteners and said joint from said exterior side of said log panels.

6. The log panel system of claim 1, further including a corner post and fasteners; said corner post to be positioned against said interior sides of two log panels, wherein one of said ends of one log panel is butted against said interior side of another of said log panels; and said fasteners to be driven through said logs of each of said log panels such that said fastener are also driven into said corner post.

7. The log panel system of claim 6, further including trim board to cover said fasteners and a joint formed on said exterior side by said log panels when butted together.

8. The log panel system of claim 1, wherein every other log on a first log panel is shorten; wherein said tongues on said logs of said first log panel not shorten are removed; wherein every other log on a second log panel is shorten; wherein said tongues on said logs of said second log panel not shorten are removed; wherein said logs shorten on said second log panel being in an alternating position as compared to said logs shorten of said first log panel, such that said first and second log panels can be mated to form a corner.

9. The log panel system of claim 8, further including a corner post to mount against said interior sides of said first and second log panels when mated to form said corner.

10. The log panel system of claim 1, further including installed electrical boxes and wire passageways.

11. The log panel system of claim 1, wherein one of said log panels is in a shape of a gable end.

12. The log panel system of claim 1, further including openings in said log panels for access into a building form by said log panels.

13. The method of making a building from log panels comprising: assembling log panels from a plurality of logs; assembling sides of the building by butting ends of said log panels together; and assembling corners of the building by butting a first log panel into a second log panel; wherein each of the logs includes a bottom with a groove and a top with a tongue; wherein the log panels are assembled by placing a first log to receive a second log on top of the first log such that the groove of the second log fits over the tongue of the first log to provide an assembly of logs; wherein fasteners are driven from above the second log into the tongue of the second log, through the second log, through the bottom of the second log, into the tongue of the first log and finally into the first log; wherein this assembly process is repeated by adding new logs and fasteners to the current assembly of logs to build the log panel and wherein an end board fixedly attached to each end of said log panel.

14. The method of making a building of claim 13, wherein each of the logs includes a bottom with a groove and a top with a tongue; and wherein the log panels are assembled by placing a first log to receive a second log on top of the first log such that the groove of the second log fits over the tongue of the first log to provide an assembly of logs, wherein fasteners are driven from above the second log into the tongue of the second log, through the second log, through the bottom of the second log, into the tongue of the first log and finally into the first log, and wherein this assembly process is repeated by adding new logs and fasteners to the current assembly of logs to build the log panel.

15. The method of making a building of claim 13, wherein said log panels are assembled to form sides of the building by butting an end of one log panel against the end of another log panel; positioning a support board on an interior side of the log panels to cover a joint formed by butting the log panels together; driving fasteners into and through the logs of each log panel near the joint and driving the fasteners such that the fasteners are driven on into the support board.

16. The method of claim 15, further including positioning a gusset over top logs of the log panels to form the side, over the joint formed by the top logs and over the support board; and driving fasteners into the gusset and on through to the logs and support board.

17. The method of making a building of claim 13, wherein corners are assembled by butting an end of the first log panel into an interior side of one end of the second log panel; positioning a corner post such that one side of the corner post is against interior side of first log panel while another side of the corner post is against the interior side of the second log panel; driving fasteners into the ends of the log panels from the exterior side and on into the corner post.

18. The method of making a building of claim 13, wherein the corners are assembled by having a first log panel having every other log on one end of the first log panel shorten; having every other log on one end of the second log panel shorten, whereby the shortening of the logs on the first log panel is alternated with the shortening of the logs of the second log panel, such that the ends of both log panels may be mated; removing the tongues on the logs not shorten on each log panel; and mating the ends of the first and second log panel where the logs have been shorten.

19. The method of making a building of claim 18, further including mounting a corner post against interior sides of the first and second log panels where the log panels are mated to form said corner and driving fasteners into the corner post and logs of the first and second log panels.

20. The method of making a log panel having at top, bottom and two ends comprising;

using logs having a top with a tongue and a bottom with a groove;

placing a first log to receive a second log on top of the first log such that the groove of the second log fits over the tongue of the first log;

placing the second log on top of the first log;

driving fasteners from above the second log into the tongue of the second log, through the second log, through the bottom of the second log, into the tongue of the first log and finally into the first log; and fixedly fastening an end board to each end of said log panel.

* * * * *